US006515635B2

(12) United States Patent
Chiang et al.

(10) Patent No.: US 6,515,635 B2
(45) Date of Patent: Feb. 4, 2003

(54) ADAPTIVE ANTENNA FOR USE IN WIRELESS COMMUNICATION SYSTEMS

(75) Inventors: Bing Chiang, Melbourne, FL (US); James A. Proctor, Jr., Indialantic, FL (US); Griffin K. Gothard, Satellite Beach, FL (US); Kenneth M. Gainey, Satellite Beach, FL (US); Joe T. Richeson, Melbourne, FL (US)

(73) Assignee: Tantivy Communications, Inc., Melbourne, FL (US)

( * ) Notice: Subject to any disclaimer, the term of this patent is extended or adjusted under 35 U.S.C. 154(b) by 0 days.

(21) Appl. No.: 09/846,693

(22) Filed: May 1, 2001

(65) Prior Publication Data

US 2002/0036595 A1 Mar. 28, 2002

Related U.S. Application Data

(60) Provisional application No. 60/234,610, filed on Sep. 22, 2000.

(51) Int. Cl.[7] ..... H01Q 19/10; H01Q 21/00

(52) U.S. Cl. ..... 343/834; 343/836; 343/837; 343/853

(58) Field of Search ..... 343/834, 835, 343/836, 837, 850, 853, 893, 854

(56) References Cited

U.S. PATENT DOCUMENTS

| | | | | |
|---|---|---|---|---|
| 3,560,978 | A | 2/1971 | Himmel et al. | 343/106 |
| 3,725,938 | A | 4/1973 | Black et al. | 343/120 |
| 3,846,799 | A | 11/1974 | Gueguen | 343/833 |
| 3,950,753 | A | 4/1976 | Chisholm | 343/106 |
| 4,021,813 | A | 5/1977 | Black et al. | 343/768 |
| 4,099,184 | A | 7/1978 | Rapshys | 343/875 |
| 4,260,994 | A | 4/1981 | Parker | 343/854 |
| 4,387,378 | A | 6/1983 | Henderson | 343/854 |
| 4,631,546 | A | 12/1986 | Dumas et al. | 343/833 |
| 4,700,197 | A | 10/1987 | Milne | 343/837 |
| 5,027,125 | A | 6/1991 | Tang | 342/368 |
| 5,235,343 | A | 8/1993 | Audren et al. | 343/816 |
| 5,293,172 | A | 3/1994 | Lamberty et al. | 343/701 |
| 5,294,939 | A | 3/1994 | Sanford et al. | 343/836 |
| 5,479,176 | A | 12/1995 | Zavrel, Jr. | 342/374 |
| 5,617,102 | A | 4/1997 | Prater | 342/374 |
| 5,767,807 | A | 6/1998 | Pritchett | 342/374 |

(List continued on next page.)

OTHER PUBLICATIONS

Chelouah, A., et al. "Angular Diversity Based on Beam Switching of Circular Arrays for HIPERLAN Terminals," *Electronics Letters*, vol. 36, No. 5, Mar. 2, 2000, pp. 387–388.

Durnan, G.J., et al., "Switched Parasitic Feeds for Parabolic Antenna Angle Diversity," *Microwave and Optical Tech. Letters*, vol. 23, No. 4, Nov. 20, 1999, pp. 200–203.

(List continued on next page.)

*Primary Examiner*—Hoang Nguyen
(74) *Attorney, Agent, or Firm*—Hamilton, Brook, Smith & Reynolds, P.C.

(57) ABSTRACT

A directive antenna includes plural antenna elements in an antenna assemblage. A feed network connected to the antenna elements includes at least one switch to select a state of one of the antenna elements to be in an active state in response to a control signal. The other antenna elements are in a passive state, electrically coupled to an impedance to be in a reflective mode. The antenna elements in the passive state are electromagnetically coupled to the active antenna element, allowing the antenna assemblage to directionally transmit and receive signals. The directive antenna may further include an assisting switch associated with each antenna element to assist coupling the antenna elements, while in the passive state, to the respective impedances. The antenna assemblage may be circular for a 360° discrete scan in N directions, where N is the number of antenna elements. The directive antenna is suitable for use in a high data rate network having greater than 50 kbits per second data transfer rates, where the high data rate network may use CDMA2000, 1eV-DO, 1Extreme, or other such protocol.

28 Claims, 12 Drawing Sheets

U.S. PATENT DOCUMENTS

| | | | | |
|---|---|---|---|---|
| 5,905,473 | A | 5/1999 | Taenzer | 343/834 |
| 6,034,638 | A | 3/2000 | Thiel et al. | 343/702 |
| 6,037,905 | A | 3/2000 | Koscica et al. | 343/701 |
| 6,100,843 | A | 8/2000 | Proctor, Jr. et al. | 342/368 |
| 6,317,092 | B1 | 11/2001 | de Schweinitz et al. | 343/753 |
| 6,337,664 | B1 * | 1/2002 | Mayes et al. | 343/749 |

OTHER PUBLICATIONS

Durnan, G.J., et al., "Optimization of Microwave Parabolic Antenna Systems Using Switched Parasitic Feed Structures," URSI National Science Meeting, Boulder, CO, Jan. 4–8, 2000, p. 323.

Giger, A.J., *Low–Angle Microwave Propagation: Physics and Modeling*, Norwood, MA: Artech House, 1991.

Harrington, R.F., "Reactively Controlled Antenna Arrays," *IEEE APS International Symposium Digest*, Amherst, MA Oct. 1976, pp. 62–65.

Harrington, R. F. "Reactively Controlled Directive Arrays," *IEEE Trans. Antennas and Propagation*, vol. AP–26, No. 3, May, 1978, pp. 390–395.

James, J.R. et al., "Electrically Short Monopole Antennas with Dielectric or Ferrite Coatings," *Proc. IEEE*, vol. 125, Sep. 1978, pp. 793–803.

James, J.R.,et al., "Reduction of Antenna Dimensions with Dielectric Loading," *Electronics Letters*, vol., 10, No. 13, May, 1974, pp. 263–265.

King, R.W.P., "The Many Faces of the Insulated Antenna," *Proc. IEEE*, vol. 64, No. 2, Feb., 1976, pp. 228–238.

Kingsley, S.P., et al., "Beam Steering and Monopulse Processing of Probe–Fed Dielectric Resonator Antennas," *IEEE Proc.—Radar, Sonar Navig.*, vol. 146, No. 3, Jun. 1999, pp. 121–125.

Knight, P., "Low–Frequency Behaviour of the Beverage Aerial," *Electronics Letters*, vol. 13, No. 1, Jan., 1977, pp. 21–22.

Long, S. A., et al., "The Resonant Cylindrical Dielectric Cavity Antenna," *IEEE Trans. Antennas and Propagation*, vol. AP–31, No. 3, May 1983, pp. 406–412.

Lu, J.,et al., "Multi–beam Switched Parasitic Antenna Embedded in Dielectric for Wireless Communications Systems," *Electronics Letters*, vol. 37, No. 14, Jul. 5, 2001, pp. 871–872.

Luzwick, J., et al., "A Reactively Loaded Aperture Antenna Array," *IEEE Trans. Antennas and Propagation,* vol. AP–26, No. 4, Jul., 1978, pp. 543–547.

Milne, R.M.T., "A Small Adaptive Array Antenna for Mobile Communications," *IEEE APS International Symposium Digest*, 1985, pp 797–800.

McAllister, M.W. et al., "Resonant Hemispherical Dielectric Antenna," *Electronics Letters*, vol. 20, No. 16, Aug. 1984, pp. 657–659.

McAllister, M.E. et al., "Rectangular Dielectric Resonator Antenna," *Electronics Letters*, vol. 19, No. 6, Mar. 1983, pp. 218–219.

Preston, S., et al., "Direction Finding Using a Switched Parasitic Antenna Array," *IEEE APS International Symposium Digest*, Montreal, Canada, 1997, pp. 1024–1027.

Preston, S.L., et al., "Base–Station Tracking in Mobile Communications Using a Switched Parasitic Antenna Array," *IEEE Trans. Antennas and Propagation*, vol. 46, No. 6, Jun., 1998, pp. 841–844.

Preston, S.L., et al., "Systematic Approach to the Design of Directional Antennas Using Switched Parasitic and Switched Active Elements," *Asia Pacific Microwave Conference Proceedings*, Yokohama, Japan, 1998, pp. 531–534.

Preston, S.L., et al., "Size Reduction of Switched Parasitic Directional Antennas Using Genetic Algorithm Optimisation Techniques," *Asia Pacific Microwave Conference Proceedings*, Yokohama, Japan, 1998, pp. 1401–1404.

Preston, S.L., et al., "A Multibeam Antenna Using Switched Parasitic and Switched Active Elements for Space–Division Multiple Access Applications," *IEICE Trans. Electron.*, vol. E82–C, No. 7, Jul. 1999, pp. 1202–1210.

Preston, S.L., et al., "Electronic Beam Steering Using Switched Parasitic Patch Elements," *Electronics Letters*, vol. 33, No. 1, Jan. 2, 1997, pp. 7–8.

Ruze, J., "Lateral–Feed Displacement in a Paraboloid," *IEEE Trans. Antennas and Propagation*, vol. 13, 1965, pp. 660–665.

Scott, N.L., et al., "Diversity Gain from a Single–Port Adaptive Antenna Using Switched Parasitic Elements Illustrated with a Wire and Monopole Prototype," *IEEE Trans. Antennas and Propagation*, vol. 47, No. 6, Jun. 1999, pp. 1066–1070.

Sibille, A. et al., "Circular Switched Monopole Arrays for Beam Steering Wireless Communications," *Electronics Letters*, vol. 33, No. 7, Mar. 1997, pp. 551–552.

Vaughn, R., "Switched Parasitic Elements for Antenna Diversity," *IEEE Trans. Antennas and Propagation*, vol. 47, No. 2, Feb. 1999, pp. 399–405.

* cited by examiner

ADAPTIVE ANTENNA FOR USE IN WIRELESS COMMUNICATION SYSTEMS

RELATED APPLICATION(S)

This application claims the benefit of U.S. Provisional Application No. 60/234,610, filed on Sep. 22, 2000, the entire teachings of which is incorporated herein by reference.

FIELD OF INVENTION

This invention relates to cellular communication systems, and, more particularly, to an apparatus for use by mobile subscriber units to provide directional transmitting and receiving capabilities.

BACKGROUND OF THE INVENTION

The bulk of existing cellular antenna technology belongs to a low- to medium-gain omni-directional class. An example of a unidirectional antenna is the Yagi antenna shown in FIG. 1. The Yagi antenna 100 includes reflective antenna elements 105, active antenna element 110, and transmissive antenna elements 115. During operation, both the reflective and transmissive antenna elements 105, 115, respectively, are electromagnetically coupled to the active antenna element 110. Both the reflective antenna elements 105 and the transmissive antenna elements 115 re-radiate the electromagnetic energy radiating from the active antenna element 110.

Because the reflective antenna elements 105 are longer than the active antenna element 110 and spaced appropriately from the active antenna element 110, the reflective antenna elements 105 serve as an electromagnetic reflector, causing the radiation from the active antenna element 110 to be directed in the antenna beam direction 120, as indicated. Because the transmissive antenna elements 115 are shorter than the active antenna element 110 and spaced appropriately from the active antenna element 110, electromagnetic radiation is allowed to propagate (i.e., transmit) past them. Due to its size, the Yagi antenna 100 is typically found on large structures and is unsuitable for mobile systems.

For use with mobile systems, more advanced antenna technology types provide directive gain with electronic scanning, rather than being fixed, as in the case of the Yagi antenna 100. However, the existing electronics scan technologies are plagued with excessive loss and high cost, contrary to what the mobile cellular technology requires.

Conventional phased arrays with RF combining networks have fast scanning directive beams. However, the feed network loss and mutual coupling loss in a conventional phased array tend to cancel out any benefits hoped to be achieved unless very costly alternatives, such as digital beam forming techniques, are used.

In U.S. Pat. No. 5,905,473, an adjustable array antenna—having a central, fixed, active, antenna element and multiple, passive, antenna elements, which are reflective (i.e., re-radiates RF energy)—is taught. Active control of the passive elements is provided through the use of switches and various, selectable, impedance elements. A portion of the re-radiated energy from the passive elements is picked up by the active antenna, and the phase with which the re-radiated energy is received by the active antenna is controllable.

SUMMARY OF THE INVENTION

The present invention provides an inexpensive, electronically scanned, antenna array apparatus with low loss, low cost, medium directivity, and low back-lobe, as required by high transmission speed cellular systems operating in a dense multi-path environment. The enabling technology for the invention is an electronic reflector array that works well in a densely packed array environment. The invention is suitable for any communication system that requires indoor and outdoor communication capabilities. Typically, the antenna array apparatus is used with a subscriber unit. Other than the feed network, the antenna apparatus can be any form of phased array antenna.

According to the principles of the present invention, the directive antenna includes multiple antenna elements in an antenna assemblage. A feed network connected to the antenna elements includes at least one switch to select a state of one of the antenna elements to be in an active state in response to a control signal. The other antenna elements are in a passive state, electrically coupled to an impedance to be in a reflective state. The antenna elements in the passive state are electromagnetically coupled to the selected active antenna element, allowing the antenna assemblage to directionally transmit and receive signals. In contrast to U.S. Pat. No. 5,905,473, which has at least one central, fixed, active, antenna element, the present invention selects one passive antenna element to be in an active state, receiving re-radiated energy from the antenna elements remaining in the passive state.

The directive antenna may further include an assisting switch associated with each antenna element to assist coupling the antenna elements, while in the passive state, to the respective impedances. The impedances are composed of impedance components. The impedance components include a delay line, lumped impedance, or combination thereof. The lumped impedance includes inductive or capacitive elements.

In the case of a single switch in the feed network, the switch is preferably a solid state switch or a micro-electro machined switch (MEMS).

The antenna assemblage may be circular for a 360° discrete scan in N directions, where N is the number of antenna elements. At least one antenna element may be a sub-assemblage of antenna elements. The antenna elements may also be telescoping antenna elements and/or have adjustable radial widths. The passive antenna elements may also be adjustable in distance from the active antenna elements.

The impedance to which the antenna elements are coupled in the passive state are typically selectable from among plural impedances. A selectable impedance is composed of impedance components, switchably coupled to the associated antenna element, where the impedance component includes a delay line, lumped impedance, or combination thereof. The lumped impedance may be a varactor for analog selection, or capacitor or inductor for predetermined values of impedance.

The directive antenna is suitable for use in a high data rate network having greater than 50 kbits per second data transfer rates. The high data rate network may use CDMA2000, 1eV-DO, 1Extreme, or other such protocol.

BRIEF DESCRIPTION OF THE DRAWINGS

The foregoing and other objects, features and advantages of the invention will be apparent from the following more particular description of preferred embodiments of the invention, as illustrated in the accompanying drawings in which like reference characters refer to the same parts throughout the different views. The drawings are not necessarily to scale, emphasis instead being placed upon illustrating the principles of the invention.

DETAILED DESCRIPTION OF THE INVENTION

A description of preferred embodiments of the invention follows.

Figure 2:
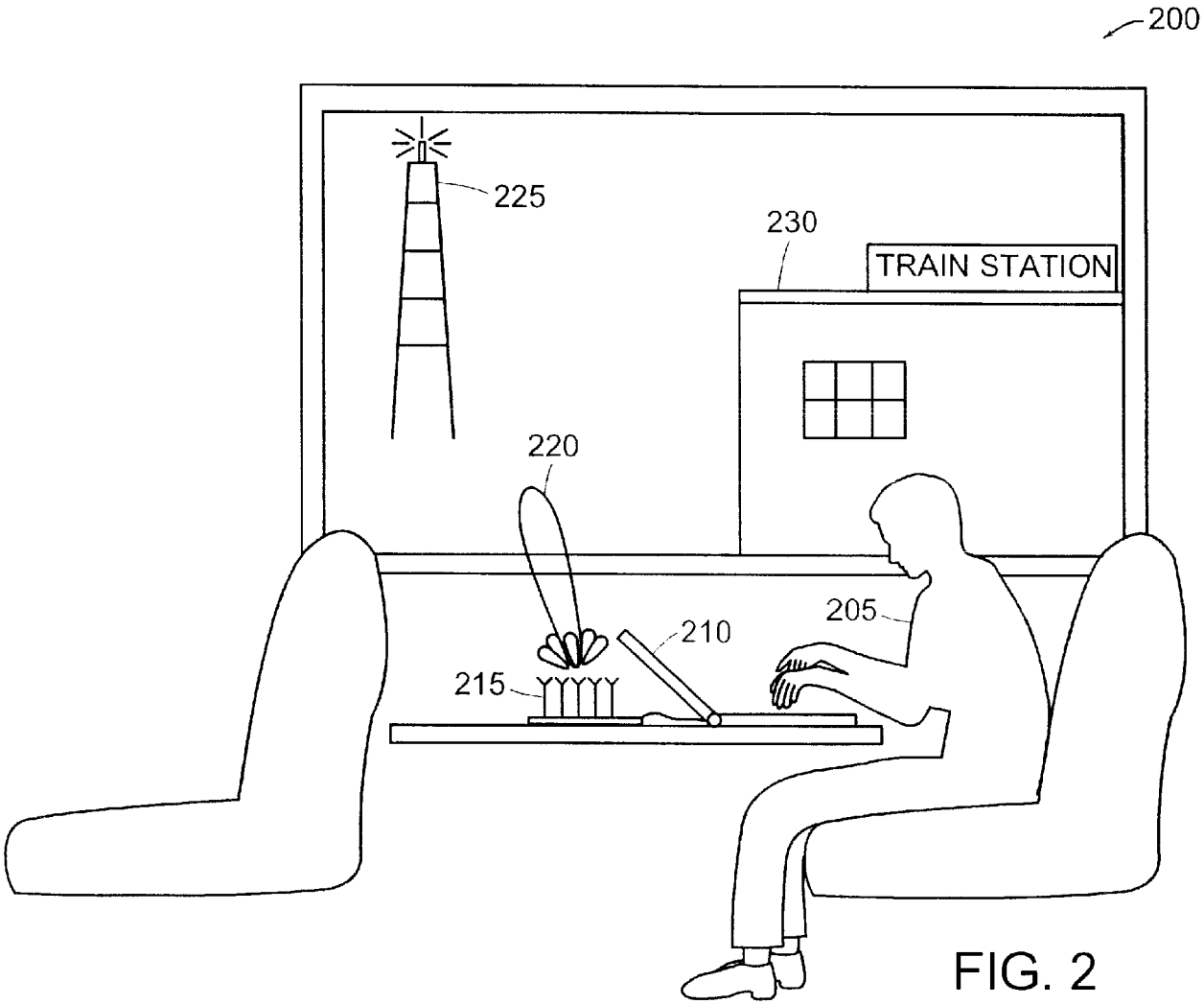
FIG. 2 is an illustration of an environment in which the present invention directive antenna may be employed.

FIG. 2 is an environment in which a directive antenna, also referred to as an adaptive antenna, is useful for a subscriber unit (i.e., mobile station). The environment 200 shows a passenger 205 on a train using a personal computer 210 to perform wireless data communication tasks. The personal computer 210 is connected to a directive antenna 215. The directive antenna 215 produces a directive beam 220 for communicating with an antenna tower 225 having an associated base station (not shown).

As the train pulls away from train station 230, the angle between the directive antenna 215 and the antenna tower 225 changes. As the angle changes, it is desirable that the directive antenna 215 change the angle of the directive beam 220 to stay on target with the antenna tower 225. By staying directed toward the antenna tower 225, the directive beam 220 maximizes its gain in the direction of the antenna tower 225. By having a high gain between the antenna tower 225 and the directive antenna 215, the data communications have a high signal-to-noise ratio (SNR).

Techniques for determining the direction of the beams in both forward and reverse links (i.e., receive and transmit beams, respectively, from the point of view of the subscriber unit) are provided in U.S. patent application Ser. No. 09/776,396 filed Feb. 2, 2001, entitled "Method and Apparatus for Performing Directional Re-Scan of an Adaptive Antenna," by Proctor et al., the entire teachings of which are incorporated herein by reference. For example, the subscriber unit may optimize the forward link beam pattern based on a received pilot signal. The reverse link beam pattern may be based on a signal quality of a given received signal via a feedback metric over the forward link. Further, the subscriber unit may steer a reverse beam in the direction of a maximum received power of a forward beam from a given base station, while optimizing a forward beam on a best signal-to-noise (SNR) or carrier-to-interference (C/I) level.

Figure 3:
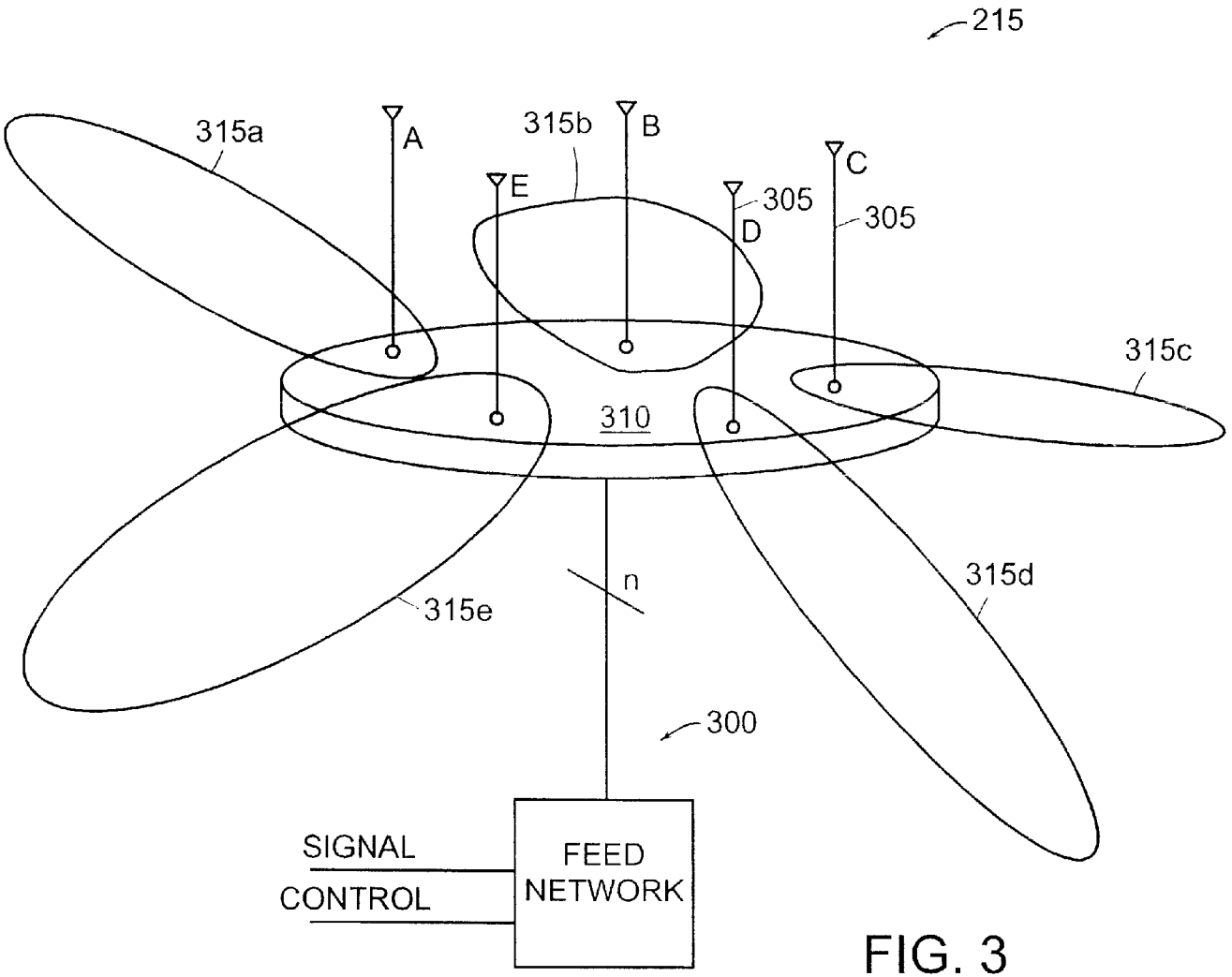
FIG. 3 is a mechanical diagram of the directive antenna of FIG. 2 operated by a feed network.

FIG. 3 is a close-up view of an embodiment of the directive antenna 215. The directive antenna 215 is an antenna assemblage having five antenna elements 305. The antenna elements 305 are labeled A–E.

The antenna elements 305 are mechanically coupled to a base 310, which includes a ground plane on the upper surface of the base. By arranging the antenna elements 305 in a circular pattern, the directive antenna 215 can scan discretely in 360, at 72 intervals, as indicated by beams 315*a*, 315*b*, . . . , 315*e* corresponding to antenna elements 305 (A–E). In other words, one antenna element 305 is active at any one time as provided by feed network 300. Thus, if antenna A is active, then a respective antenna beam 315*a* is produced, since antenna elements B–E are in a reflective mode while antenna A is active. Similarly, the other antenna elements 305 produce beams, when active, in a direction away from the reflective antenna elements. It should be understood that the directive antenna is merely exemplary in antenna element count and configuration and that more or fewer antenna elements 305 and configuration changes may be employed without departing from the principles of the present invention.

The low loss of the directive antenna 215 is realized by using practically lossless reflective elements, and only one active element, which is selectable by a switch, as later described. Low cost is achieved by changing from the conventional RF combining network concept, which employs power dividers and costly phase shifters, to a passive reflector array. Medium directivity and low back lobe are made possible by keeping the element spacing to a small fraction of a wavelength. The close spacing normally means high loss, due to excess mutual coupling. But, in a reflective mode, the coupled power is re-radiated rather than lost.

Electronic scanning is implemented through a relatively low loss, single-pole, multi-throw switch, in one embodiment. Continuous scanning, if opted, is achieved through perturbing the phases of antenna elements in the reflective mode.

The directive antenna 215 typically has 7 to 8 dBi of gain, which is an improvement over the 4 to 5 dBi found in comparable conventionally fed phased arrays. Various embodiments of the directive antenna 215 and feed network 300 are described below.

Figure 4:
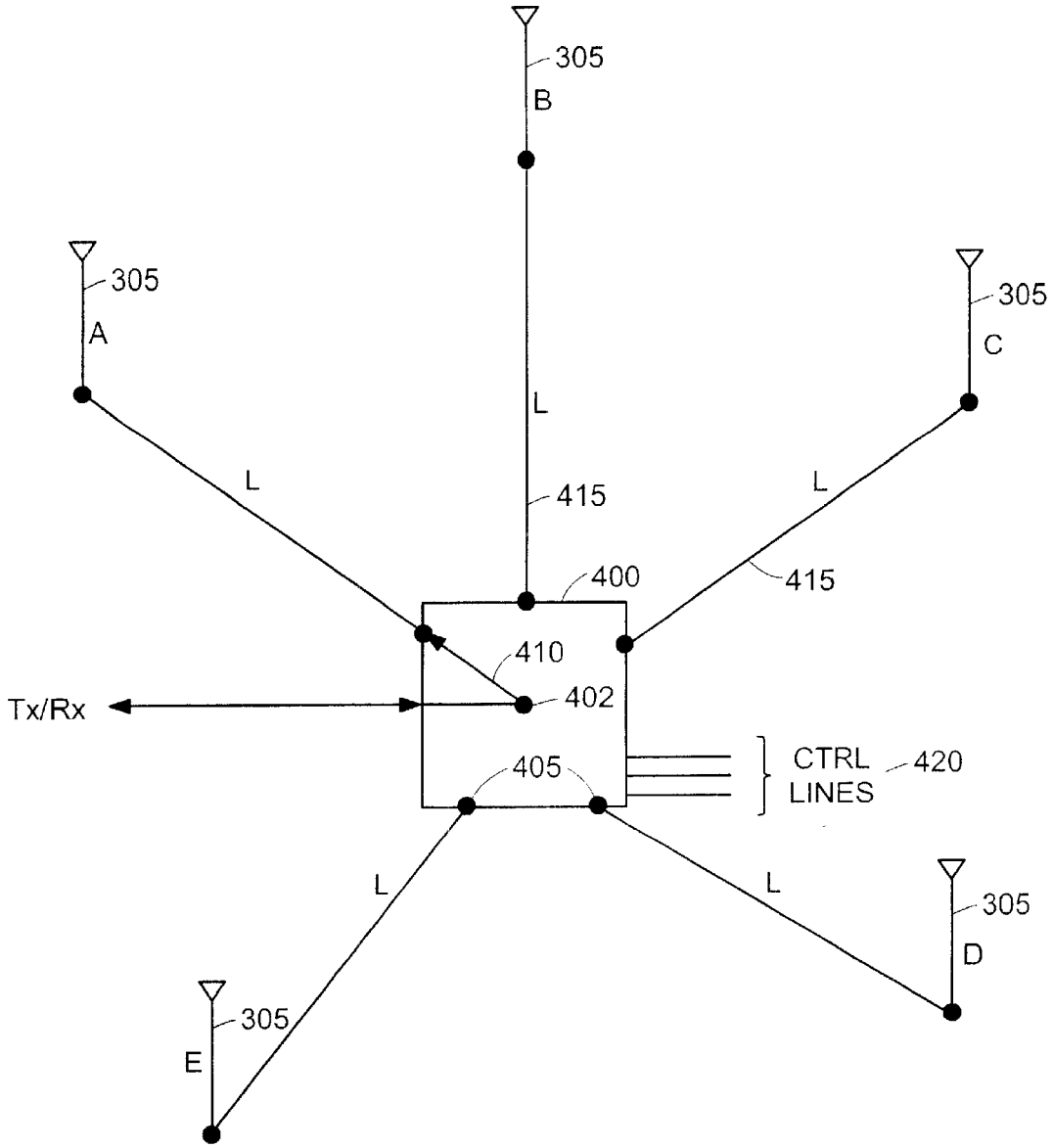
FIG. 4 is a schematic diagram of an embodiment of the feed network having a switch used to control the directive antenna of FIG. 3.

FIG. 4 is a schematic diagram of the directive antenna 215 having an embodiment of a feed network comprising a single switch to control which antenna element 315 is active. The switch 400 is a single-pole, multiple-throw switch having the pole 402 connected to a transmitter/receiver (Tx/Rx) (not shown). The switch 400 has a switching element 410 that electrically connects the pole 402 to one of five terminals 405. The terminals 405 are electrically connected to respective antenna elements 305 via transmission lines 415. The transmission lines are 50-ohm and have the same length, L, spanning from the switch 400 to the antenna elements 305.

In this embodiment, the switch 400 is shown as being a mechanical type of switch. Although possible to use a mechanical switch, a mechanical switch tends to be larger in physical dimensions than desirable, plus not typically robust for many operations and slow. Therefore, switches of other types of technologies are preferably employed. No matter the type of switch technology chosen, the performance should be high impedance in the 'open' state, and provide excellent transmittance (i.e., low impedance) in the 'closed' state. Once such technology is micro-electro machine switch (MEMS) technology, which does, in fact, provide "hard-opens" (i.e., high impedance) and "shorts" (i.e., very low impedance) in a mechanical manner.

Alternatively, gallium arsenide (GaAs) provides a solid-state switch technology that, when high-enough quality, can provide the necessary performance. The concern with solid-state technology, however, is consistency and low-loss reflectivity from port-to-port and chip-to-chip. Good quality characteristics allow for high quantity production rates yielding consistent antenna characteristics having improved directive gain. Another solid state technology embodiment includes the use of a pin diode having a 0.1 dB loss, as discussed below in reference to FIG. 6.

In operation, a controller (not shown) provides control signals to control lines 420 that control the state of the switch 400. The controller may be any processing unit, digital or analog, capable of performing typical processing and control functions. A binary coded decimal (BCD) representation of the control signal determines which antenna element 305 is active in the antenna array. The active antenna, again, determines the direction in which the directive beam is directed.

In the state shown, the switch 400 couples the Tx/Rx to antenna A. If the switch 400 were coupled to more than eight antenna elements, then more than three control lines 420 would be necessary (e.g., four control lines can select sixteen different switch states).

Figure 5:
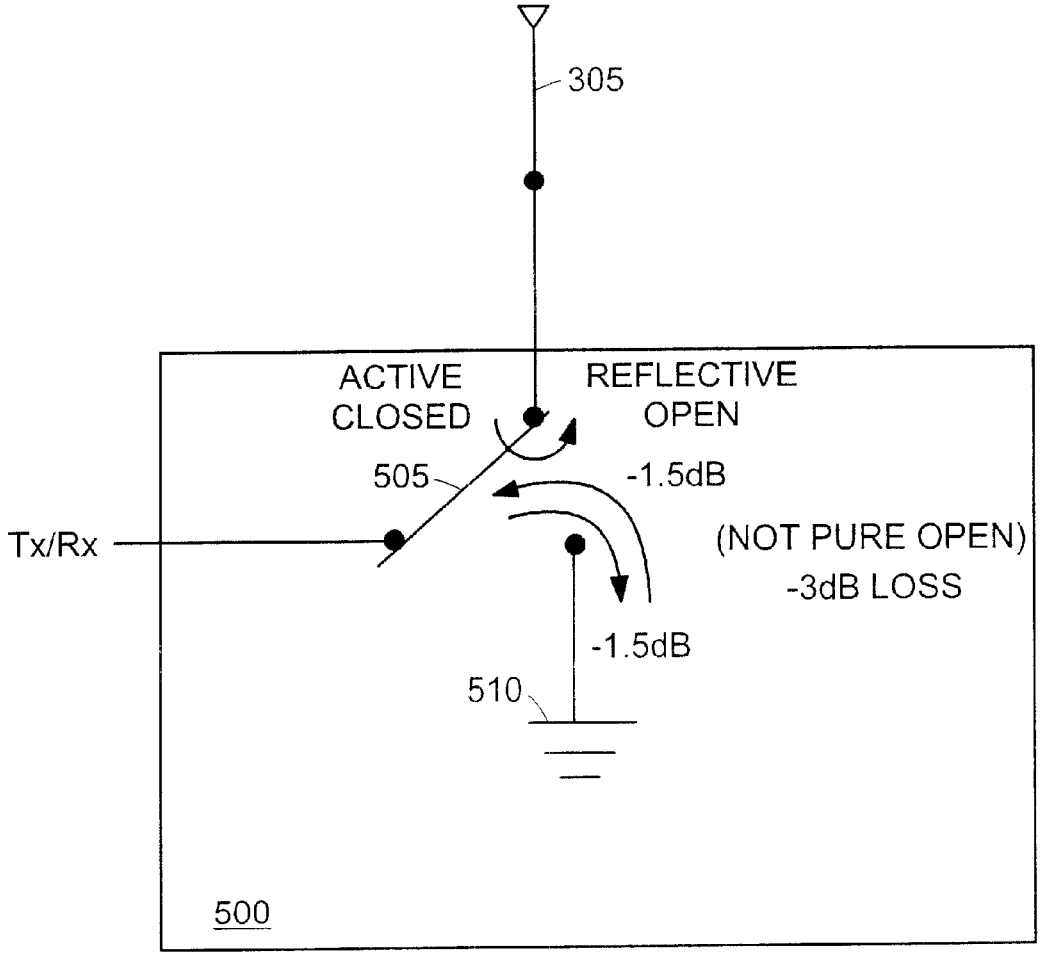
FIG. 5 is a schematic diagram of a solid state switch having losses exceeding an acceptable level for use in the circuit of FIG. 4.

FIG. 5 is an example of a solid state switch 500 that has been found less optimal than a switch providing a hard open. The solid state switch 500 has a single-pole, double-throw configuration. In the closed-state as shown, the switch 500 has a pole 505 providing signals from the Tx/Rx to the antenna 305. However, in the closed-state, there is electrical coupling from the pole 505 to a ground terminal 510.

The electrical coupling is due to the fact the solid-state technology (e.g., CMOS) does not provide complete isolation from the pole 505 to the ground terminal 510 in the state shown. As a result, there is a −1.5 dB loss in the direction from the pole 505 to the ground terminal 510, and a reflected loss of −1.5 dB from the ground terminal 510 back to the pole 505. The cumulative loss is −3 dB. In other words, the advantage gained by using the directive antenna 215 is lost due to the electrical characteristics of this solid state switch 500. In the other switch embodiments described herein, the losses described with respect to this solid state switch 500 are not found, and, therefore, offer viable switching solutions.

Figure 6:
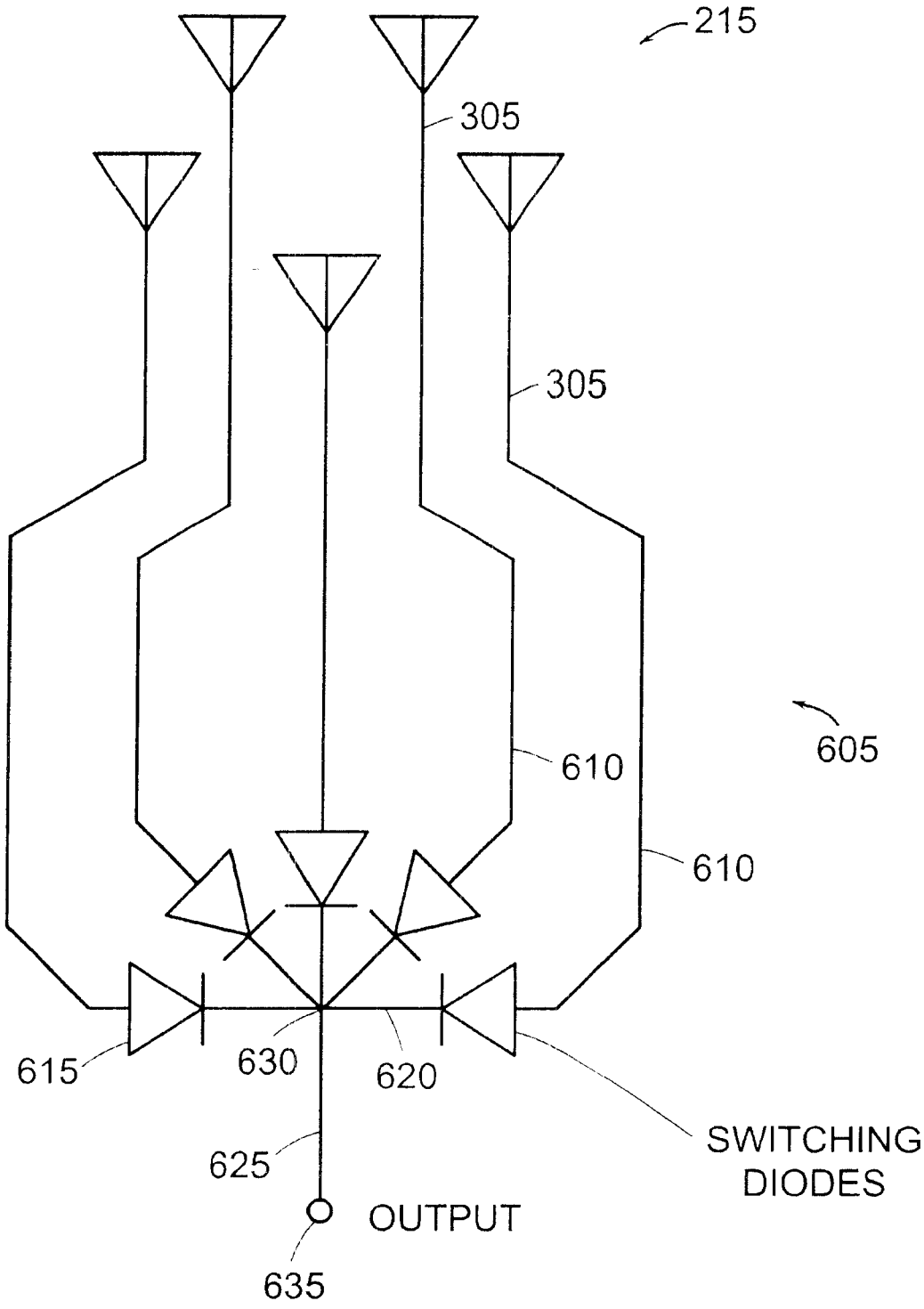
FIG. 6 is a schematic diagram of an alternative embodiment of the feed network used to control the directive antenna of FIG. 3.

FIG. 6 is a schematic diagram of an alternative five element antenna array 215. The antenna array 215 is fed by a single-path network 605. The network 605 includes five 50-ohm transmission lines 610, each being connected to a respective antenna element 305. The other end of each transmission line 610 is connected respectively to a switching diode 615. Each diode 615 is connected, in turn, to one of five additional 50 ohm transmission lines 620. The transmission lines 620 are also connected to a 50-ohm transmission line 625 at a junction 630. The transmission line 625 is connected to the junction 630 and an output 635.

In use, four of the five diodes 615 are normally open. The open diodes serve as open-circuit terminations for the four associated antenna elements so that these antenna elements are in a reflective mode. The remaining diode is conducting, thus connecting the fifth antenna to the output 635 and making the respective antenna active. All the transmission lines 610 have the same impedance because there is no power combining; there is only power switching. Selection of the state of the diodes is made through the use of respective DC control lines (not shown).

Figure 7:
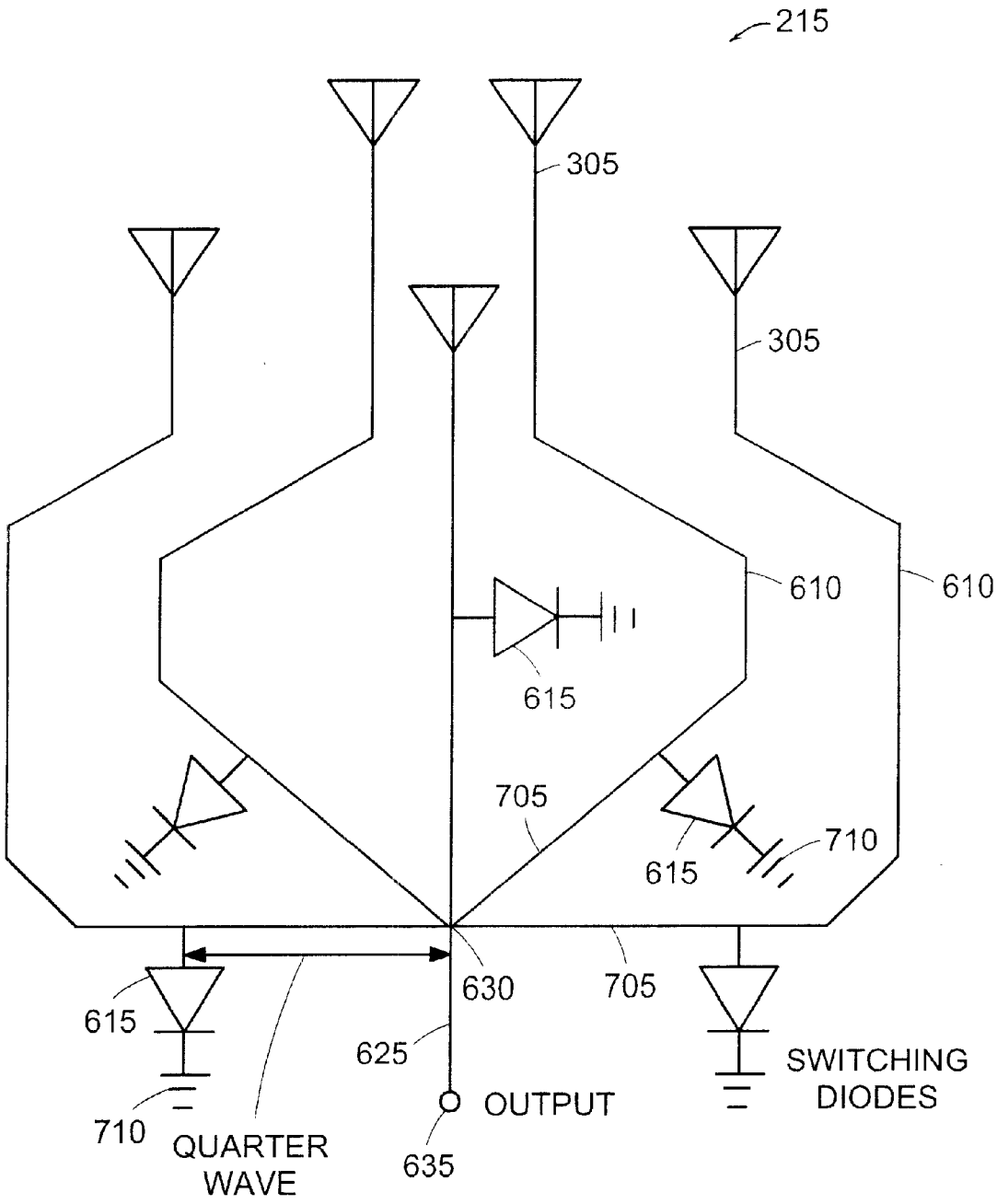
FIG. 7 is a schematic diagram of an alternative embodiment of the feed network of FIG. 6.

Other embodiments of the invention differ slightly from the embodiment of FIG. 6. For example, another embodiment, shown in FIG. 7, has the antenna array 215 having five antenna elements 305, each being connected to one of five transmission lines 610. Each of the transmission lines 610, is connected, in turn, to a switching diode 615 and a quarter-wave line 705 connecting at a junction 630. The quarter-wave lines 705 are connected to an output 635 through an output line 625.

In operation, four of the five diodes 615 are shorted. Through a respective quarter-wave line 705, each diode 615 appears as an open circuit when viewed from the junction 630. This is the dual of the circuit discussed above in reference to FIG. 6, so that the impedance shown to the reflective antenna elements 305 is a short circuit. It is further observed that the lengths of the transmission lines 610 connecting the diodes 615 to the antenna elements 305 can be sized to adjust the amount of phase delay between the diodes 615 and antenna elements 305.

Figure 8:
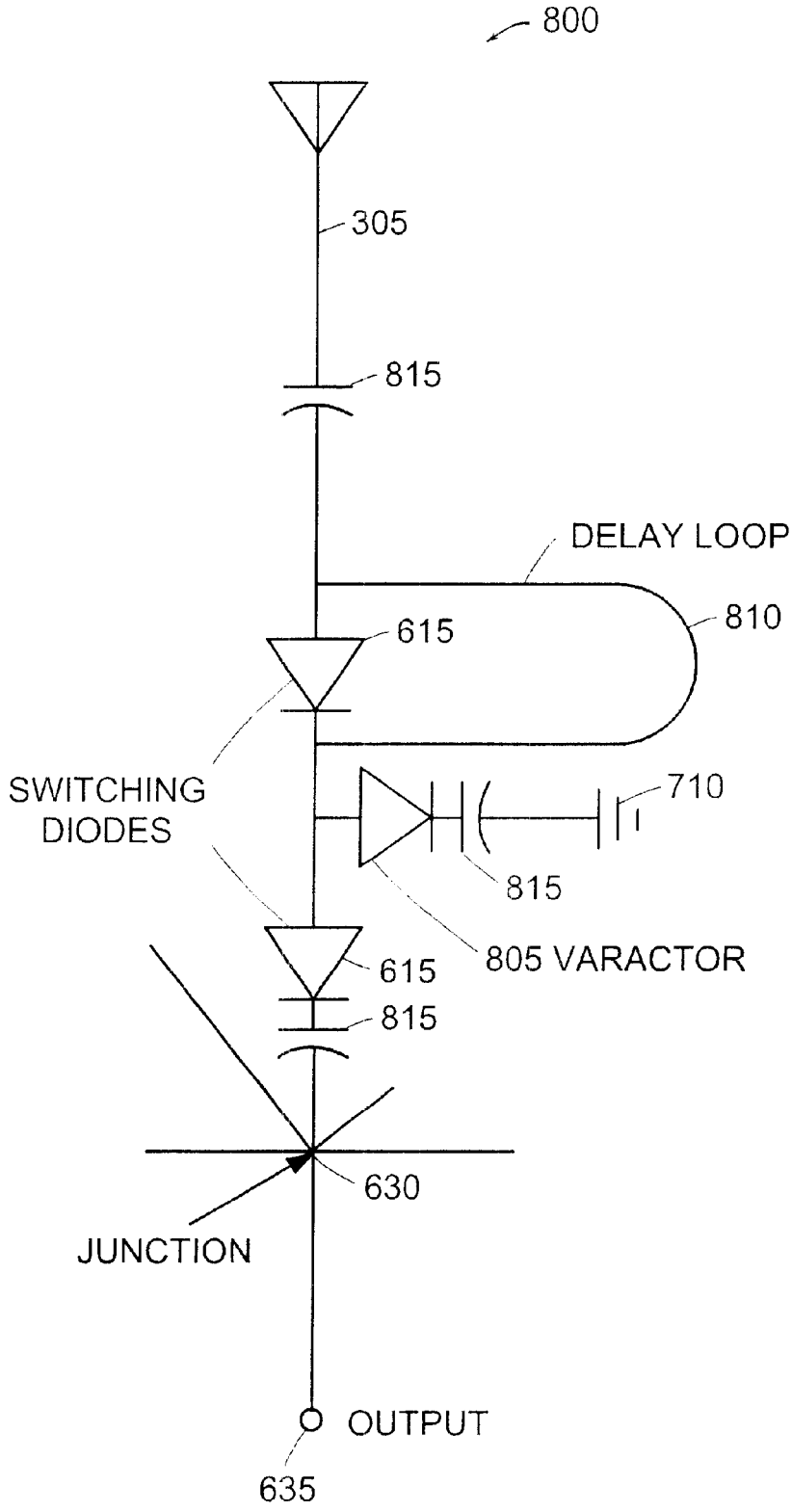
FIG. 8 is a schematic diagram of yet another alternative embodiment of the feed network of FIG. 6.

FIG. 8 is yet another embodiment of a feed network for controlling the antenna array 215. Shown is a single branch 800 of the feed network, where the single branch 800 provides continuous scanning rather than mere step scanning, as in the case of the branches of the previous network 605. The continuous scanning is achieved by providing individual phase control to the reflective elements.

There are three diodes on each branch 800. One diode is a first switching diode 615, located closest to the junction 630, which is used for the selection of the antenna element 305 that is to be active. The second diode is a varactor 805, which provides the continuously variable phase to the antenna element 305 when in a reflective mode. The third diode is another switching diode 615, which adds one digital phase bit to the antenna element 305 when in the reflective mode, where the phase bit is typically 180°. The phase is added by the delay loop 810, which is coupled to both anode and cathode of the second switching diode 615. The phase bit is used to supplement the range of the varactor 805. The capacitors 815 are used to pass the RF signal and inhibit passage of the DC control signals used to enable and disable the diodes 615.

Figure 9:
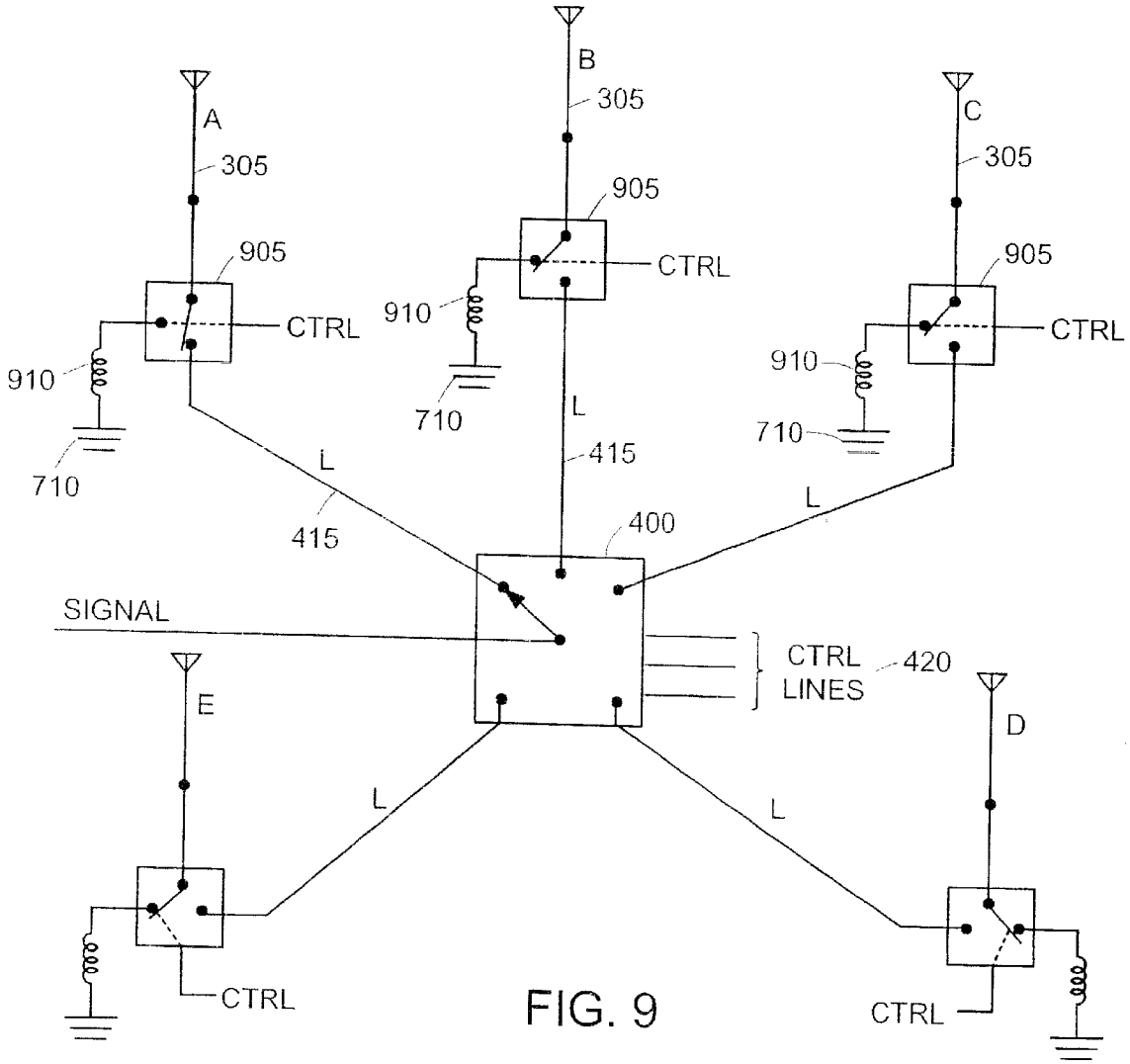
FIG. 9 is a schematic diagram of an alternative embodiment of the feed network of FIG. 4.

FIG. 9 is yet another embodiment in which one of the antenna elements 305 is in active mode, and four of the five antenna elements 305 are in reflective modes. A central switch 400 directs a signal to one of the five antenna elements 305 in response to a control signal on the control lines 420. As shown, the switch 400 is directing the signal to antenna A via the respective transmission line 415.

In this embodiment, the transmission line 415 is connected at the distal end from the switch 400 to an assisting switch 905, which is a single-pole, double-throw switch. The assisting switch 905 connects the antenna element 305 to either the transmission line 415 to receive the signal or to an inductive element 910. When coupled to the inductive element 910, the antenna element 305 has an effective length increase, causing the antenna element 305 to be in the reflective mode. This effective length increase makes the antenna element 305 appear as a reflective antenna element 105 (FIG. 1), as described in reference to the Yagi antenna.

The extra switches 905 and inductive elements 910 assist the feed network in coupling the antenna elements 305 to an inductive element, rather than using the transmission line 415 in combination with the open circuit of the central switch 400 to provide the inductance. The assisting switch 905 is used, in particular, when the central switch 400 is lossy or varies in performance from port-to-port when open circuited. A typical assisting switch 905 has a −0.5 dB loss, which is more efficient than the −3 dB loss of the central switch 500 (FIG. 5).

It should be understood that, though an inductive element 910 is shown, the inductive element can be any form of impedance, predetermined or dynamically varied. Impedances can be a delay line or lumped impedance where the lumped impedance, includes inductive and/or capacitive elements. It should also be understood that the assisting switches 905, as in the case of the central switch 400, can be solid state switches, micro-electro machined switches (MEMS), pin diodes, or other forms of switches that provide the open and closed circuit characteristics required for active and passive performance characteristics by the antenna elements 305.

Figure 10:
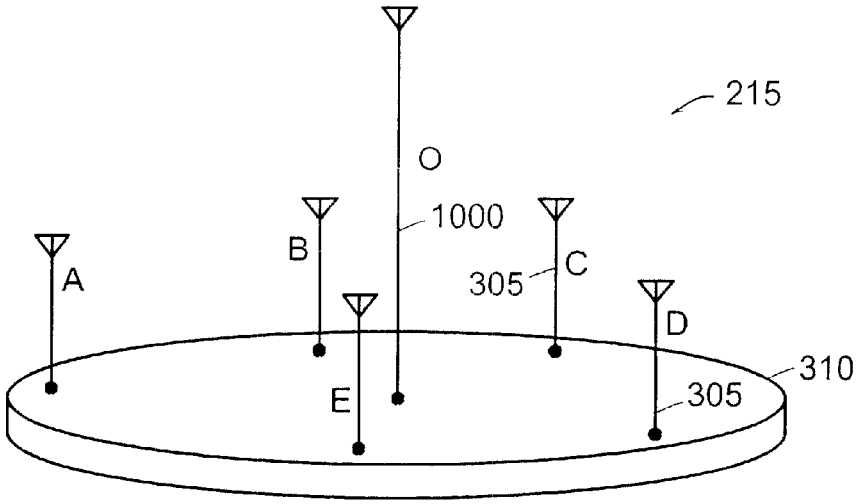
FIG. 10 is a schematic diagram of an alternative embodiment of the directive antenna of FIG. 3 having an omnidirectional mode.
Figure 10:
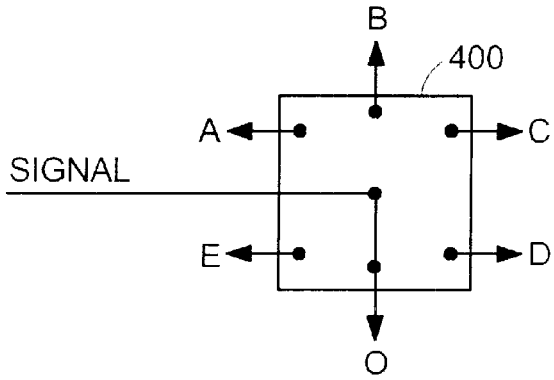

FIG. 10 is an alternative embodiment of the antenna assembly 215 of FIG. 3. In this embodiment, the same five antenna elements 305 are included on the base 310. This embodiment also includes a longer antenna element (antenna O) 1000, which is used for omni-directional mode. To allow for the omni-directional mode, the switch 400 includes a sixth terminal to which antenna O is connected. When the signal is provided to antenna O, the other antenna elements 305 are in reflective mode. Although the other antenna elements 305 are in reflective mode, the extended length of the omni-directional antenna, antenna O, facilitates transmitting and receiving signals over the other antenna elements 305. Antenna O may be telescoping, so as to allow a user to keep antenna O short unless omni-directional mode is desired.

Figure 11:
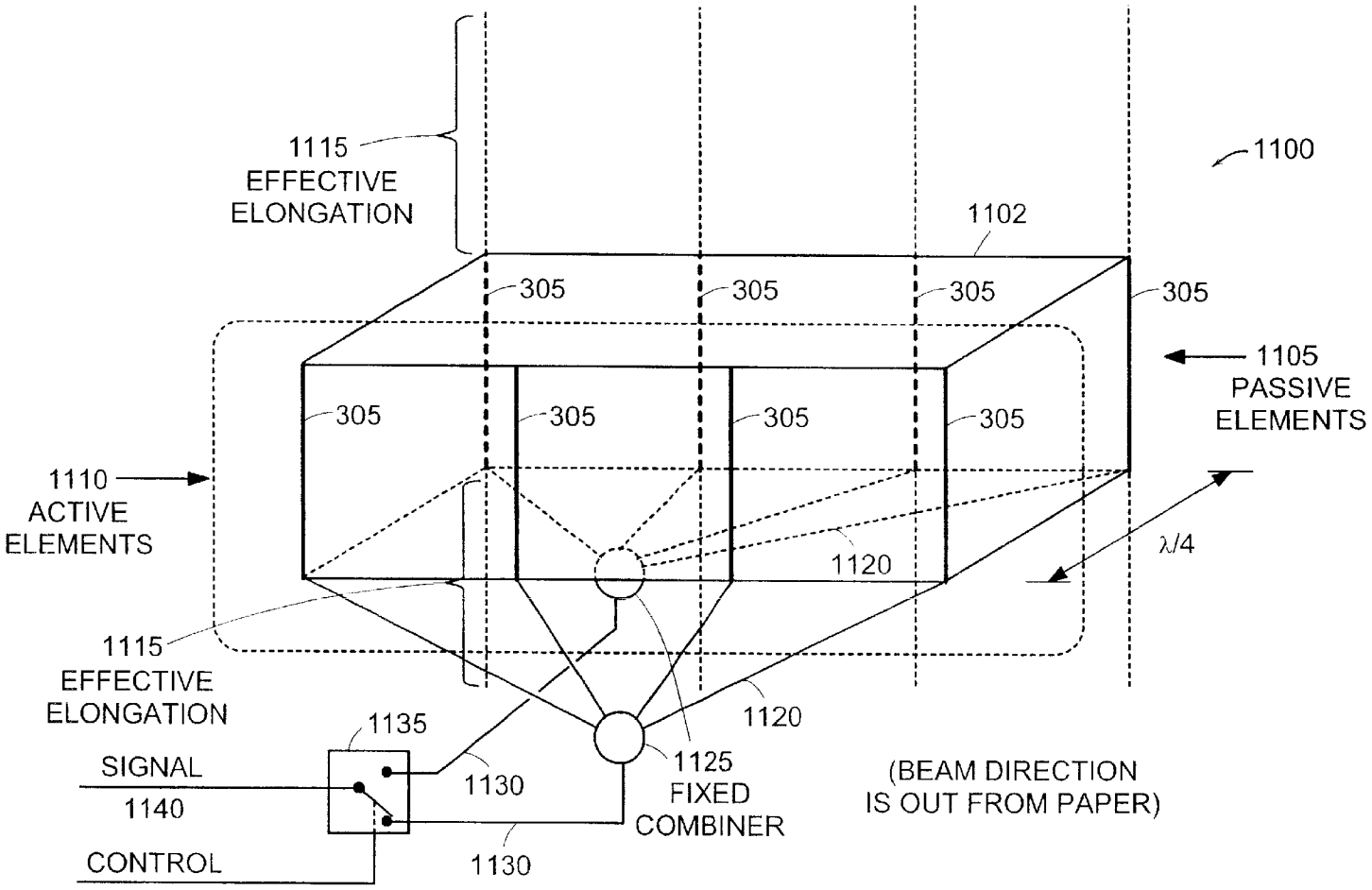
FIG. 11 is a schematic diagram of yet another alternative embodiment of the directive antenna of FIG. 3.

FIG. 11 is an alternative embodiment of the antenna assembly 215 (FIG. 3) that may be operated by teachings of the present invention. Here, an antenna assembly 1100 is formed in the shape of a rectangular assembly 1102. The antenna elements 305 are located vertically on the sides of the assembly 1102. Transmission lines 1120 each have the same length and 50-ohm impedance and electrically connect the antenna elements 305 to fixed combiners 1125. Through another pair of transmission lines 1130 that have 50-ohm impedances, the fixed combiners 1125 are electrically connected to a single-pole, single-throw switch 1135.

The switch 1135 is controlled by a control signal 1145 and transmits RF signals 1140 to, or receives RF signals 1140 from, the antenna elements 305.

Figure 1:
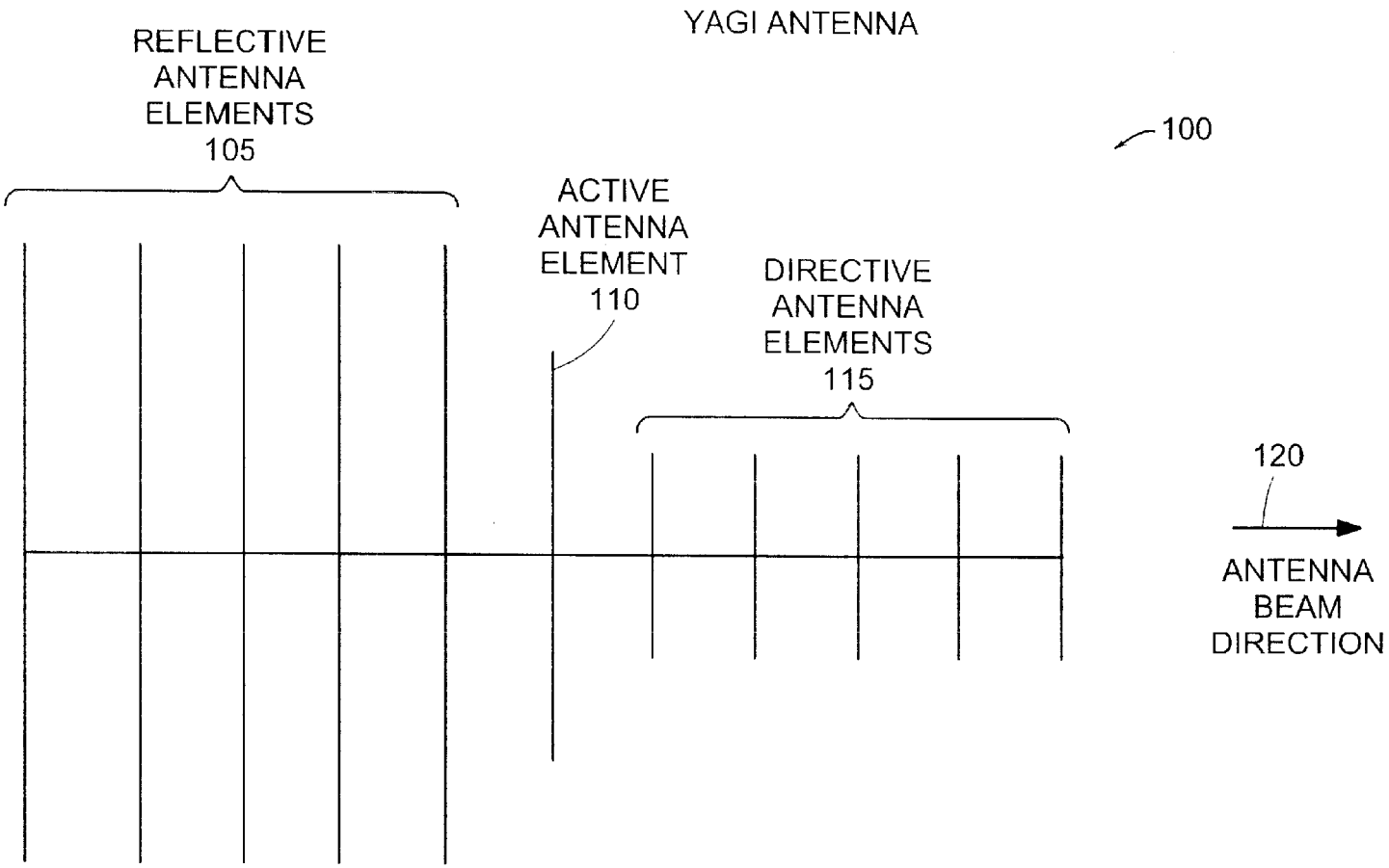
FIG. 1 PRIOR ART
FIG. 1 is a prior art directional antenna.

Rather than having a single antenna element connected to the switch 1135, the embodiment of FIG. 11 has the antenna elements 305 arranged in two arrays: one array on the front of the assembly 1102 and a second array on the rear of the assembly 1102. In operation, the switch 1135 determines which array of antenna elements 305 is in reflective mode and which array is in active mode. As depicted, the antenna elements on the front of the assembly 1102 are active elements 1110, and the antenna elements 305 on the rear of the assembly 1102 are passive elements 1105. The arrays are separated by, for example, one-quarter wavelengths, thus electromagnetically coupling the active elements 1110 and passive elements 1105 together to cause the passive elements 1105 to re-radiate electromagnetic energy. As indicated, the passive antenna elements 1105 have effective elongation 1115 above and below the assembly 1102 recall the Yagi antenna 100 (FIG. 1).

It should be understood that the switch 1135 has the same performance characteristics as the central switch 40, as described above. Further, similar feed network arrangements as those described above could be employed in the embodiment of FIG. 12 without departing from the principles of the present invention. Also, it should be noted that (i) the transmission lines 1120 spanning between the antenna elements 305 and the fixed combiners 1125 are the same lengths and (ii) the transmission lines 1130 spanning from the switch 1135 to the fixed combiners 1125 are the same lengths. In this way, the antenna patterns fore and aft of the assembly 1100 are the same, both when the antenna elements on the front of the assembly 1100 are active and when the antenna elements 305 at the back of the assembly 1100 are active.

Figure 12:
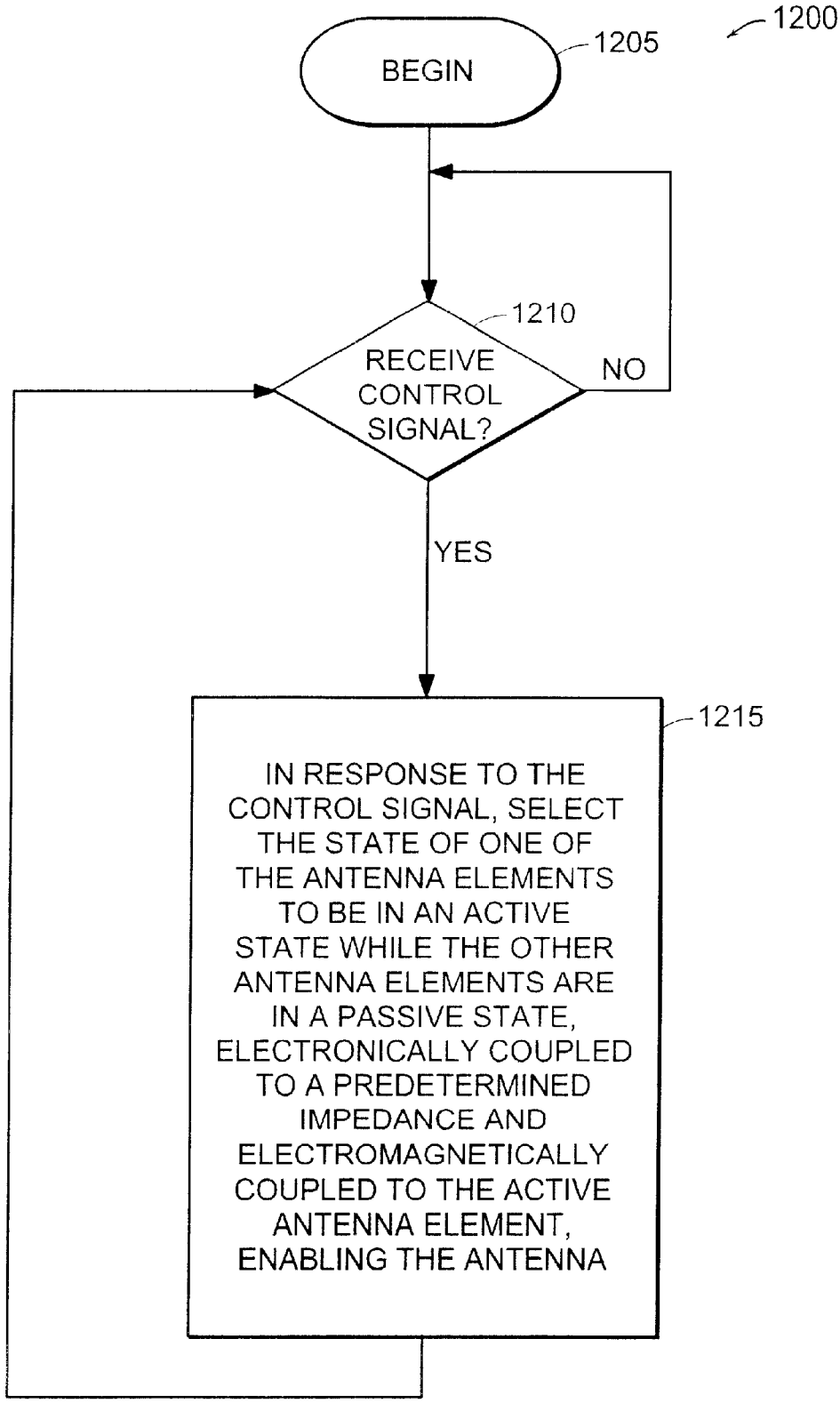
FIG. 12 is a flow diagram of an embodiment of a process used to operate the directive antenna of FIG. 3.

FIG. 12 is a flow diagram of an embodiment of a process 1200 used when operating the directive antenna 215. The process 1200 begins in step 1205. In step 1210, the process 1200 determines if a control signal has been received. If a control signal has been received, then, in step 1215, the process 1200, in response to the control signal, selects the state of one of the antenna elements 305, or antenna assemblages in an embodiment such as shown in FIG. 11, to be in an active state while the other antenna elements 305 are in a passive state. In the passive state, the antenna elements 305 are electrically coupled to a predetermined impedance and electromagnetically coupled to the active antenna element, thereby enabling the active antenna. If, in step 1210, the process 1200 determines that a control signal has not been received, the process 1200 loops back to step 1210 and waits for a control signal to be received.

The process 1200 and the various mechanical and electrical embodiments described above are suitable for use with high data rate networks having greater than 50 kbits per second data transfer rates. For example, the high data rate network may use an CDMA2000, 1eV-DO, 1Extreme, or other such protocol.

While this invention has been particularly shown and described with references to preferred embodiments thereof, it will be understood by those skilled in the art that various changes in form and details may be made therein without departing from the scope of the invention encompassed by the appended claims.

What is claimed is:

1. A directive antenna, comprising:

plural antenna elements in an antenna assemblage; and a feed network having a plurality of switches, at least one switch to select the state of one of the antenna elements to be in an active state in response to a control signal, a subset of the plurality of switches to assist electronically coupling the other antenna elements to a predetermined impedance including a delay line or lumped impedance, to be in a passive state and electromagnetically coupled to the active antenna element, allowing the antenna assemblage to directionally transmit and receive signals.

2. The directive antenna as claimed in claim 1, wherein the lumped impedance includes inductive or capacitive elements.

3. The directive antenna as claimed in claim 1, wherein the switch is a solid state switch.

4. The directive antenna as claimed in claim 1, wherein the switch is a micro electro machined switch (MEMS).

5. The directive antenna as claimed in claim 1, wherein the antenna assemblage is circular for a 360° discrete scan in N directions, where N is the number of antenna elements.

6. The directive antenna as claimed in claim 1, wherein at least one antenna element is a sub-assemblage of antenna elements.

7. The directive antenna as claimed in claim 1, wherein the antenna elements are telescoping antenna elements.

8. The directive antenna as claimed in claim 1, wherein (i) the antenna elements have adjustable radial widths or (ii) the passive antenna elements are adjustable in distance from the active antenna elements.

9. The directive antenna as claimed in claim 1, wherein the predetermined impedance is selectable from among plural predetermined impedances.

10. The directive antenna as claimed in claim 9, wherein the selectable predetermined impedances are composed of impedance components switchably coupled to the antenna elements, wherein the impedance components include a delay line, lumped impedance, or combination thereof.

11. The directive antenna as claimed in claim 10, wherein the lumped impedance is a varactor, capacitor, or inductor.

12. The directive antenna as claimed in claim 1, used in a high data rate network having greater than 50 kbits per second data transfer rates.

13. The directive antenna as claimed in claim 12, wherein the high data rate network uses a protocol selected from a group consisting of: CDMA2000, 1eVDO, and 1Extreme.

14. A method for directing a beam using a directive antenna, comprising:

providing an RF signal to or receiving one from antenna elements in an antenna assemblage; and in response to a control signal for controlling the state of a plurality of switches, selecting the state of at least one of the switches to cause one of the antenna elements in the antenna assemblage to be in an active state and selecting the state of a subset of the plurality of switches to assist electrically coupling the other antenna elements to a predetermined impedance, including a delay line or lumped impedance, to be in a passive state and electromagnetically coupled to the active antenna element, allowing the antenna assemblage to directionally transmit and receive signals.

15. The method as claimed in claim 14, wherein the lumped impedance includes inductive or capacitive elements.

16. The method as claimed in claim 14, wherein selecting one of the antenna elements includes operating a switch.

17. The method as claimed in claim 16, wherein the switch is a solid state switch, non-solid state switch, or MEMS technology switch.

18. The method as claimed in claim 14, wherein selecting one of the antenna elements includes selecting a direction from among 360° of discrete directions in N directions, where N is the number of antenna elements.

19. The method as claimed in claim 14, wherein at least one antenna element is a sub-assemblage of antenna elements.

20. The method as claimed in claim 14, further including telescoping the antenna elements.

21. The method as claimed in claim 14, further including adjusting the width of the antenna elements (i) in radial size or (ii) in distance of the passive antenna elements from the active antenna element.

22. The method as claimed in claim 14, further including selecting the predetermined impedances.

23. The method as claimed in claim 22, wherein selecting the predetermined impedances includes coupling the antenna elements to a delay line, lumped impedance, or combination thereof.

24. The method as claimed in claim 23, wherein the lumped impedance includes a varactor, capacitor, or inductor.

25. The method as claimed in claim 14, used in a high data rate network having greater than 50 kbits per second data transfer rates.

26. The method as claimed in claim 25, wherein the high data rate network uses a protocol selected from a group consisting of: CDMA2000, 1eV-DO, and 1Extreme.

27. Apparatus for directing a beam using a directive antenna, comprising:

plural antenna elements in an antenna assemblage; and means for selecting the state of one of the antenna elements in the antenna assemblage to be in an active state in response to a control signal, the other antenna elements being in a passive state, electrically coupled to a predetermined impedance including a delay line or lumped impedance and electromagnetically coupled to the active antenna element, allowing the antenna assemblage to directionally transmit and receive signals.

28. An antenna apparatus for use with a subscriber unit in a wireless communication system, the antenna apparatus comprising:

a plurality of antenna elements in an antenna assemblage; and a plurality of switches each respectively coupled to one of the antenna elements and a predetermined impedance including a delay line or lumped impedance, the switches being independently selectable to enable a respective antenna element to change between an active mode and a reflective mode enabling the antenna assemblage to directionally transmit and receive signals.

* * * * *